US008400069B2

(12) United States Patent
Tsuda

(10) Patent No.: US 8,400,069 B2
(45) Date of Patent: Mar. 19, 2013

(54) LIGHTING DEVICE AND PROJECTOR

(75) Inventor: Masahide Tsuda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 156 days.

(21) Appl. No.: 12/868,930

(22) Filed: Aug. 26, 2010

(65) Prior Publication Data

US 2011/0062881 A1 Mar. 17, 2011

(30) Foreign Application Priority Data

Sep. 14, 2009 (JP) ..... 2009-211376

(51) Int. Cl.

| | |
|---|---|
| ***H05B 41/16*** | (2006.01) |
| ***H05B 41/24*** | (2006.01) |
| ***H05B 37/02*** | (2006.01) |
| ***H05B 39/04*** | (2006.01) |
| ***H05B 41/36*** | (2006.01) |
| ***G05F 1/00*** | (2006.01) |

(52) U.S. Cl. ..... 315/246; 315/291; 315/224; 315/307; 315/209 R; 363/20; 363/15

(58) Field of Classification Search ..... 315/246, 315/291, 224, 307, 209 R, 274, 276–279, 315/247; 363/20, 21, 41, 15–17
See application file for complete search history.

(56) References Cited

U.S. PATENT DOCUMENTS

| | | | | |
|---|---|---|---|---|
| 4,912,374 | A * | 3/1990 | Nagase et al. | 315/244 |
| 5,399,943 | A * | 3/1995 | Chandrasekaran | 315/219 |
| 5,410,466 | A * | 4/1995 | Maehara | 363/98 |
| 5,500,792 | A * | 3/1996 | Jeon et al. | 363/98 |
| 5,962,981 | A * | 10/1999 | Okude et al. | 315/128 |
| 5,990,663 | A * | 11/1999 | Mukainakano | 320/134 |
| 6,919,693 | B2 * | 7/2005 | Fushimi | 315/219 |
| 7,940,353 | B2 * | 5/2011 | Tanaka | 349/65 |
| 7,973,493 | B2 * | 7/2011 | Onishi et al. | 315/291 |
| 8,049,432 | B2 * | 11/2011 | Taipale et al. | 315/282 |
| 8,115,421 | B2 * | 2/2012 | Mishima et al. | 315/307 |
| 8,129,915 | B2 * | 3/2012 | Naruo | 315/224 |
| 2009/0243503 | A1 * | 10/2009 | Iwao | 315/246 |

FOREIGN PATENT DOCUMENTS

| | | |
|---|---|---|
| JP | 2008-027711 A | 2/2008 |
| JP | 2009-054365 A | 3/2009 |

* cited by examiner

*Primary Examiner* — Shawki Ismail
*Assistant Examiner* — Dylan White
(74) *Attorney, Agent, or Firm* — AdvantEdge Law Group, LLC

(57) ABSTRACT

A lighting device which supplies power to an electrode of a discharge lamp to turn on the discharge lamp includes: a pulse generating circuit which produces a high-voltage pulse and applies the high-voltage pulse to the electrode; wherein the pulse generating circuit includes an inductor whose output end is connected with the electrode, and a capacitor connected with the output end of the inductor to produce free oscillation of current applied to the electrode in cooperation with the inductor.

9 Claims, 3 Drawing Sheets

LIGHTING DEVICE AND PROJECTOR

BACKGROUND

1. Technical Field

The present invention relates to a lighting device for turning on a discharge lamp and a projector.

2. Related Art

A projector which includes a light source, a light modulation device for modulating light emitted from the light source to form an image corresponding to image information, and a projection device for projecting the formed image is known. The light source included in this projector is often constituted by a discharge lamp such as an extra-high pressure mercury lamp containing a discharge space into which a pair of electrodes and discharge substances are sealed. In this case, a lighting control device for controlling lighting of the discharge lamp is equipped. A known type of this lighting control device includes a lighting device for supplying lamp power to the discharge lamp to turn on the discharge lamp, and a control device (control circuit) for controlling the operation of the lighting device (for example, see JP-A-2009-54365).

The lighting control device (high-pressure discharge lamp lighting device) disclosed in JP-A-2009-54365 includes a chopper circuit, a full-bridge circuit, a resonating circuit, and an igniter circuit.

The chopper circuit reduces voltage received from a direct current power source and outputs the reduced voltage to the full-bridge circuit. The full-bridge circuit converts the received direct current into alternating current and supplies the converted current to a high-pressure discharge lamp. The resonating circuit resonates by switching operation of the full-bridge circuit and produces high voltage. The igniter circuit generates pulse voltage for starting the high-pressure discharge lamp by using the high voltage produced by the resonating circuit.

It is known that a discharge lamp left in a cold and dark place comes into a hold condition where light emission substances sealed within the discharge lamp are not easily activated. Thus, for turning on the discharge lamp in this condition, lighting start voltage higher than usual is applied to the discharge lamp, for example.

According to the lighting control device shown in JP-A-2009-54365, however, the resonating circuit provided in addition to the igniter circuit generates high voltage. The high voltage thus produced can break insulation between electrodes of the discharge lamp left in the cold and dark place.

According to the lighting control device shown in JP-A-2009-54365 which has the resonating circuit and the igniter circuit separately, however, the structure of the lighting device becomes complicated. In addition, since high voltage is produced on the downstream side of the resonating circuit, a substrate, circuit elements and other components easily deteriorate.

SUMMARY

It is an advantage of some aspects of the invention to provide a lighting device and a projector having simplified structure and capable of reducing loads imposed on respective components.

According to a first aspect of the invention, there is provided a lighting device which supplies power to an electrode of a discharge lamp to turn on the discharge lamp and includes a pulse generating circuit which produces a high-voltage pulse and applies the high-voltage pulse to the electrode. The pulse generating circuit includes an inductor whose output end is connected with the electrode via a lead, and a capacitor connected with the output end of the inductor in series to produce free oscillation of current applied to the electrode in cooperation with the inductor.

The discharge lamp turned on by the lighting device is a light source lamp such as an extra-high pressure mercury lamp, for example.

According to this structure, the inductor and the capacitor of the pulse generating circuit generate high-voltage overshoot (free oscillation) of current applied to the electrode to increase voltage applied to the electrode of the discharge lamp. In this case, the necessity for providing a resonating circuit separately from the pulse generating circuit is eliminated, and thus the structure of the lighting device is simplified.

The output ends of the capacitor and the inductor are connected with the electrode of the discharge lamp via the leads. In this case, the high voltage is not applied to other components of the lighting device. Thus, loads imposed on the respective components such as circuit elements constituting the lighting device can be reduced.

According to the lighting control device disclosed in JP-A-2009-54365, there is a possibility that higher voltage than expected is outputted from the resonating circuit due to variations of the constants of the components constituting the resonating circuit, changes of the drive frequency or the like. Thus, the whole lighting circuit needs to be controlled such that desired voltage can be outputted. According to the aspect of the invention, however, the generated high voltage is directly applied via the leads. Thus, the high voltage is not allied to the components of the lighting device, and loads imposed on the components can be securely reduced.

Further, the capacity of the capacitor can be reduced to a degree that generates only voltage sufficient for canceling the hold condition of the discharge lamp left in a cold and dark place is required. Thus, the capacity of the capacitor can be reduced to be smaller than that in a structure including the resonating circuit described above.

According to the aspect of the invention, it is preferable that the pulse generating circuit has a transformer having a primary coil and a secondary coil, and that the inductor corresponds to the secondary coil.

The pulse generating circuit has a transformer for transforming (boosting) voltage in some cases. According to this aspect of the invention, the secondary coil of the transformer is used as the inductor. Thus, the necessity for providing a separate inductor is eliminated. Accordingly, the structure of the pulse generating circuit, and thus the structure of the lighting device can be further simplified.

According to a second aspect of the invention, there is provided a projector including the lighting device described above.

The projector according to the aspect of the invention can offer operations and advantages similar to those of the lighting device of the first aspect of the invention.

BRIEF DESCRIPTION OF THE DRAWINGS

The invention will be described with reference to the drawings, wherein like numbers reference like elements.

DESCRIPTION OF EXEMPLARY EMBODIMENT

An embodiment according to the invention is hereinafter described with reference to the drawings.

Figure 1:
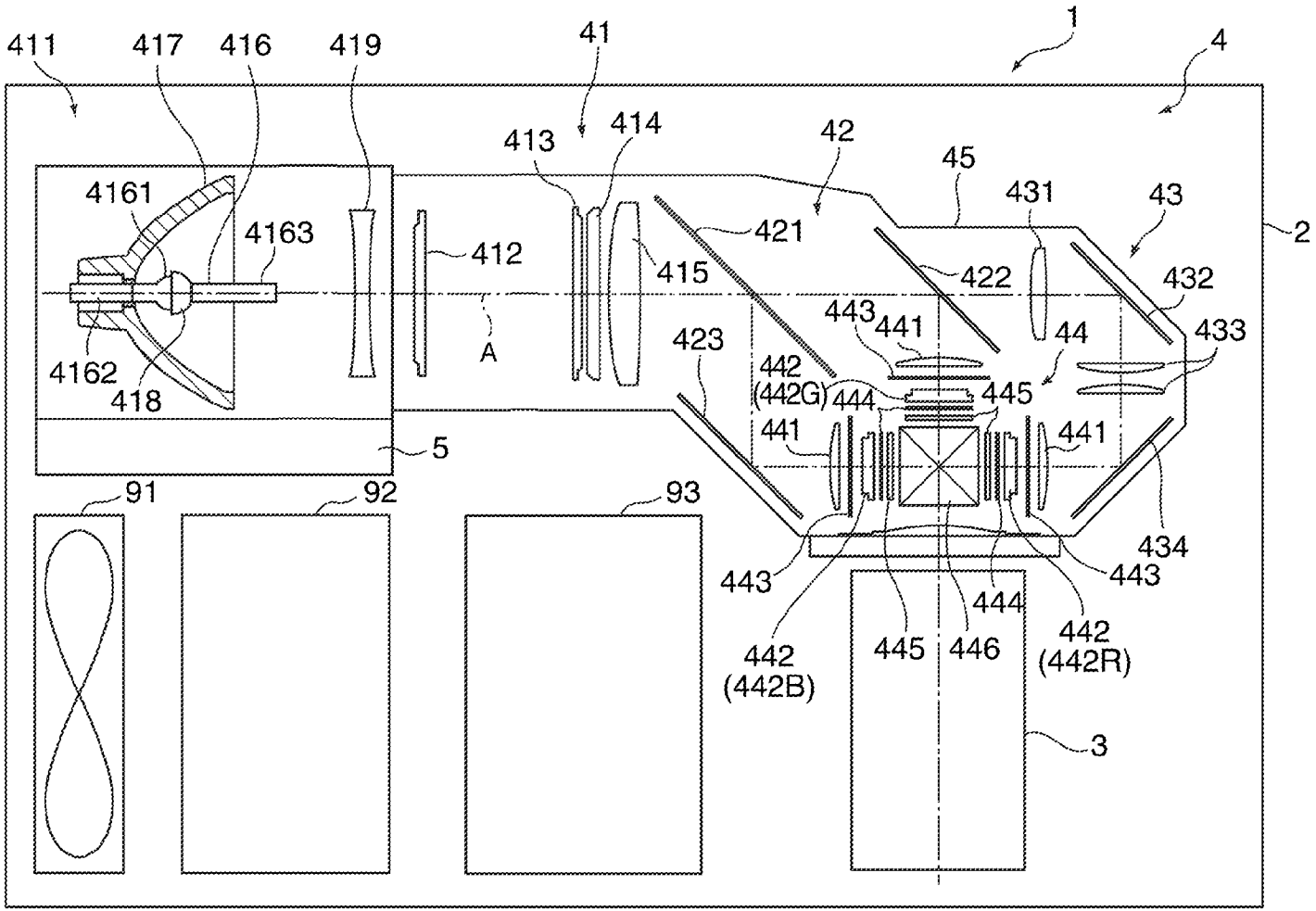
FIG. 1 schematically illustrates the structure of a projector according to an embodiment of the invention.

FIG. 1 schematically illustrates the structure of a projector 1 according to this embodiment.

The projector 1 in this embodiment forms an image corresponding to image information by modulating light emitted from a light source unit 411 contained in the projector 1 and expands and projects the image on a projection receiving surface such as a screen. As illustrated in FIG. 1, the projector includes an outer housing 2, a projection device 3, and an image forming system 4. The projector 1 further includes a cooling unit 91 having a cooling fan for cooling the interior of the projector 1 and others, a power source unit 92 for supplying power to the respective components within the projector 1, a control unit 93 for controlling the overall operation of the projector 1, and other units.

Structures of Outer Housing and Projection Device

The outer housing 2 is a housing generally having a substantially rectangular parallelepiped shape and made of synthetic resin or metal as a component for accommodating the respective devices 3 and 4, the respective units 91 through 93, and others.

The projection device 3 forms an image produced and supplied from the image forming system 4 described later on the projection receiving surface while expanding and projecting the corresponding image. The projection device 3 includes a not-shown combination of lenses accommodated within a cylindrical lens barrel.

Structure of Image Forming System

The image forming system 4 is an optical unit which forms image light corresponding to image information under the control of the control unit 93. The image forming system 4 includes an illumination device 41, a color separation device 42, a relay device 43, an electro-optic device 44, and an optical component housing 45 for accommodating and locating these devices 41 through 44 at predetermined positions on an illumination axis A determined inside the optical component housing 45 and for supporting the projection device 3.

The illumination device 41 has the light source unit 411, a pair of lens arrays 412 and 413, a polarization converting element 414, and a stacking lens 415.

The color separation device 42 has dichroic mirrors 421 and 422 and a reflection mirror 423. The relay device 43 has an entrance side lens 431, a relay lens 433, and reflection mirrors 432 and 434.

The electro-optic device 44 has a field lens 441, three liquid crystal panels 442 as light modulation devices (liquid crystal panel 442R for red light, liquid crystal panel 442G for green light, and liquid crystal panel 442B for blue light), three entrance side polarization plates 443, three visibility angle compensating plates 444, and three exit side polarization plates 445 for the corresponding color lights, and a cross dichroic prism 446 as a color combining unit.

According to the image forming system 4 having this structure, the illumination device 41 emits light having substantially uniform illuminance within an illumination area, and the color separation device 42 separates the light into three color lights in red (R), green (G), and blue (B). The respective separated color lights are modulated by the corresponding liquid crystal panels 442 according to image information to form images for the respective color lights. These images are combined by the cross dichroic prism 446, and the combined image is expanded and projected on the projection receiving surface through the projection device 3.

Structure of Light Source Unit

As illustrated in FIG. 1, the light source unit 411 includes a discharge lamp 416, a main reflection mirror 417, a sub reflection mirror 418, a collimating concave lens 419, a housing (not shown) accommodating these components 416 through 419, and a lighting control device 5 for controlling lighting of the discharge lamp 416.

The discharge lamp 416 has a substantially spherical light emission portion 4161 which contains a pair of electrodes E (E1 and E2) (see FIG. 2) and discharge substances sealed into a discharge space formed inside the discharge lamp 416, and a pair of sealing portions 4162 and 4163 extending from both ends of the light emission portion 4161 in directions away from each other. The discharge lamp 416 is constituted by an extra-high pressure mercury lamp, for example.

The main reflection mirror 417 is fixed to the sealing portion 4162 disposed on the side opposite to the lens array 412 side by an adhesive. The main reflection mirror 417 has a concave reflection surface on the inner surface of the main reflection mirror 417 such that light received from the light emission portion 4161 can be reflected by the reflection surface and converged at a second focus on the illumination axis A.

The sub reflection mirror 418 is a molded component made of glass and covering the area of the light emission portion 4161 on the sealing portion 4163 side (on the side opposite to the main reflection mirror 417 side). The sub reflection mirror 418 has a shape following the outer shape of the light emission portion 4161, and has a reflection surface in the area opposed to the light emission portion 4161. The sub reflection mirror 418 reflects light emitted toward the side opposite to the main reflection mirror 417 from the light emission portion 4161 such that the light can be supplied toward the reflection surface of the main reflection mirror 417 by reflection on the reflection surface of the sub reflection mirror 418. By this method, light emitted from the light emission portion 4161 directly toward the leading end of the light source unit 411 in the light emission direction and not reaching the lens array 412 can be reduced.

The collimating concave lens 419 collimates the light reflected and converged by the main reflection mirror 417 into light traveling in parallel with the illumination axis A.

Structure of Lighting Control Device

Figure 2:
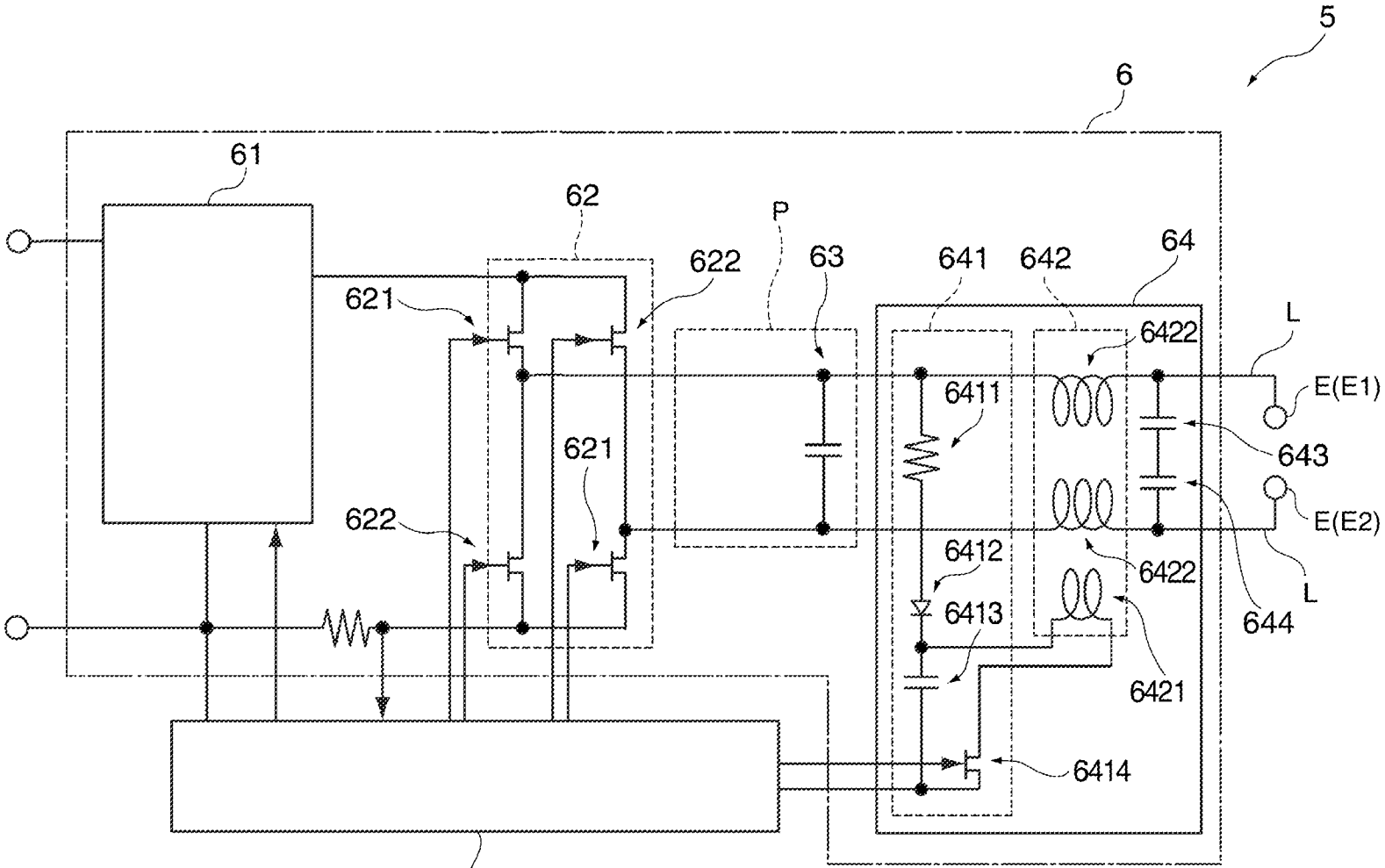
FIG. 2 is a circuit diagram showing the structure of a lighting control device according to the embodiment.

FIG. 2 is a block diagram showing the structure of the lighting control device 5.

As shown in FIG. 2, the lighting control device 5 includes a lighting device 6 which converts direct current supplied from the power source unit 92 into alternating current and outputs the converted current to the electrodes E (E1 and E2) of the discharge lamp 416 to turn on the discharge lamp 416, and a controller 7 for controlling the lighting device 6 under the control of the control unit 93.

Structure of Lighting Device

The lighting device 6 includes a voltage reducing circuit 61, a converting circuit 62, a capacitor 63, and a pulse generating circuit 64.

The voltage reducing circuit 61 is a down-chopper circuit which reduces direct current (approximately 380V, for example) inputted from the power source unit 92 to a voltage (in the range from about 50V to about 150V, for example) appropriate for the discharge lamp 416 under the control of the controller 7. Though not specifically shown in the figure, the voltage reducing circuit 61 has FETs (field effect transistors) as switching elements and coils connected in series, and diodes and capacitors branched from these elements for connection, for example. The FETs reduce inputted direct current to a desired voltage in response to gate voltage applied by the controller 7. The coils, diodes, and capacitors perform processes for removal of high-frequency components contained in the inputted direct current, for rectification, and for conversion into constant power.

The converting circuit 62 is an inverter circuit which converts the inputted direct current into alternating current. The converting circuit 62 is a bridge circuit having a pair of FETs 621 and a pair of FETs 622. The converting circuit 62 receives direct current rectified by the voltage reducing circuit 61. When the controller 7 described later applies gate voltage to the FETs 621 and FETs 622, current flows in a path containing the pair of the FETs 621 and a path containing the pair of the FETs 622 with these paths alternately short-circuited, thereby producing alternating current. The converting circuit 62 is driven at a high frequency (such as frequency of 10 kHz or higher) before lighting of the discharge lamp 416, and is driven at a low frequency (such as frequency of 1 kHz or lower) after lighting.

The capacitor 63 is a coupling capacitor for connecting the converting circuit 62 and the pulse generating circuit 64.

The pulse generating circuit 64 is an igniter circuit which operates at the start of lighting of the discharge lamp 416. More specifically, the pulse generating circuit 64 outputs high-voltage pulses to the electrodes E for dielectric breakdown between the electrodes E and initiates actuation of the discharge lamp 416. The pulse generating circuit 64 is disposed between the converting circuit 62 and the discharge lamp 416 in such a condition that the pulse generating circuit 64 and the discharge lamp 416 are connected in parallel. The pulse generating circuit 64 has a primary circuit 641, an igniter transformer (hereinafter abbreviated as "transformer" in some cases) 642, and capacitors 643 and 644.

The primary circuit 641 has a resistor 6411, a diode 6412, a capacitor 6413, and an FET 6414 as a switching element. In the primary circuit 641, current inputted from the converting circuit 62 is rectified by the diode 6412 via the resistor 6411, and then applied to the capacitor 6413 to allow accumulation of charges in the capacitor 6413. When gate voltage as a trigger signal is applied to the FET 6414 with sufficient charges accumulated in the capacitor 6413, the FET 6414 is brought into ON condition (conduction condition) to release the charges accumulated in the capacitor 6413. As a result, large pulse current flows into a primary coil 6421 of the transformer 642 via the FET 6414.

The transformer 642 has the primary coil 6421 and a secondary coil 6422. The primary coil 6421 is connected with the output end of the primary circuit 641. The secondary coil 6422 functions as an inductor of the invention. The input end of the secondary coil 6422 is connected with the converting circuit 62, and the output end of the secondary coil 6422 is connected with the electrodes E (E1 and E2).

The transformer 642 having this structure transforms (boosts) current flowing in the secondary coil 6422 in accordance with current flowing in the primary coil 6421. Thus, when the pulse current explained above flows in the primary coil 6421, high-voltage pulses (such as approximately 6 kV) are generated in the secondary coil 6422.

The capacitors 643 and 644 are connected with the output end of the secondary coil 6422. In other words, the capacitors 643 and 644 are connected with each other in series in such a condition that the capacitors 643 and 644 and the electrodes E are connected in parallel as viewed from the converting circuit 62. The capacitors 643 and 644 reduces voltage by producing free oscillation (overshoot) of the alternating current outputted from the transformer 642 in cooperation with the secondary coil 6422 prior to application of the high-voltage pulses, and applies the reduced voltage to the electrodes E.

The capacitors 643 and 644 as dual capacitors have resistance to high voltage, and continue operation even when one of these fails.

The capacitors 643 and 644 and the output ends of the secondary coil 6422 are connected with the electrodes E of the discharge lamp 416 via leads L. For example, the transformer 642 and the capacitors 643 and 644 are mounted on a circuit substrate with the output ends of these components 642 through 644 connected with the electrodes E via the leads L.

Dielectric Breakdown Between Electrodes

When a discharge lamp is left in a cold and dark place, light emission substrates are difficult to be activated as explained above. Thus, dielectric breakdown between the electrodes of the discharge lamp in this condition cannot be easily achieved by using high-voltage pulses to be applied to the electrodes when the discharge lamp is not left in such a place in some cases. This condition is hereinafter referred to as hold condition.

For canceling the hold condition, that is, for producing a condition allowing the high-voltage pulses outputted from the secondary coil 6422 to cause dielectric breakdown, high-voltage is applied to the electrodes E beforehand for a predetermined period (in this embodiment, a period until charges are accumulated in the capacitor 6413) prior to application of the high-voltage pulses, for example.

According to this embodiment, the capacitors 643 and 644 increase (raise) the peak value of the output voltage from the transformer 642 by the free oscillation at the time of operation of the converting circuit 62 at a high frequency as explained above (before lighting of the discharge lamp 416 and before operation of the pulse generating circuit 64).

Figure 3:
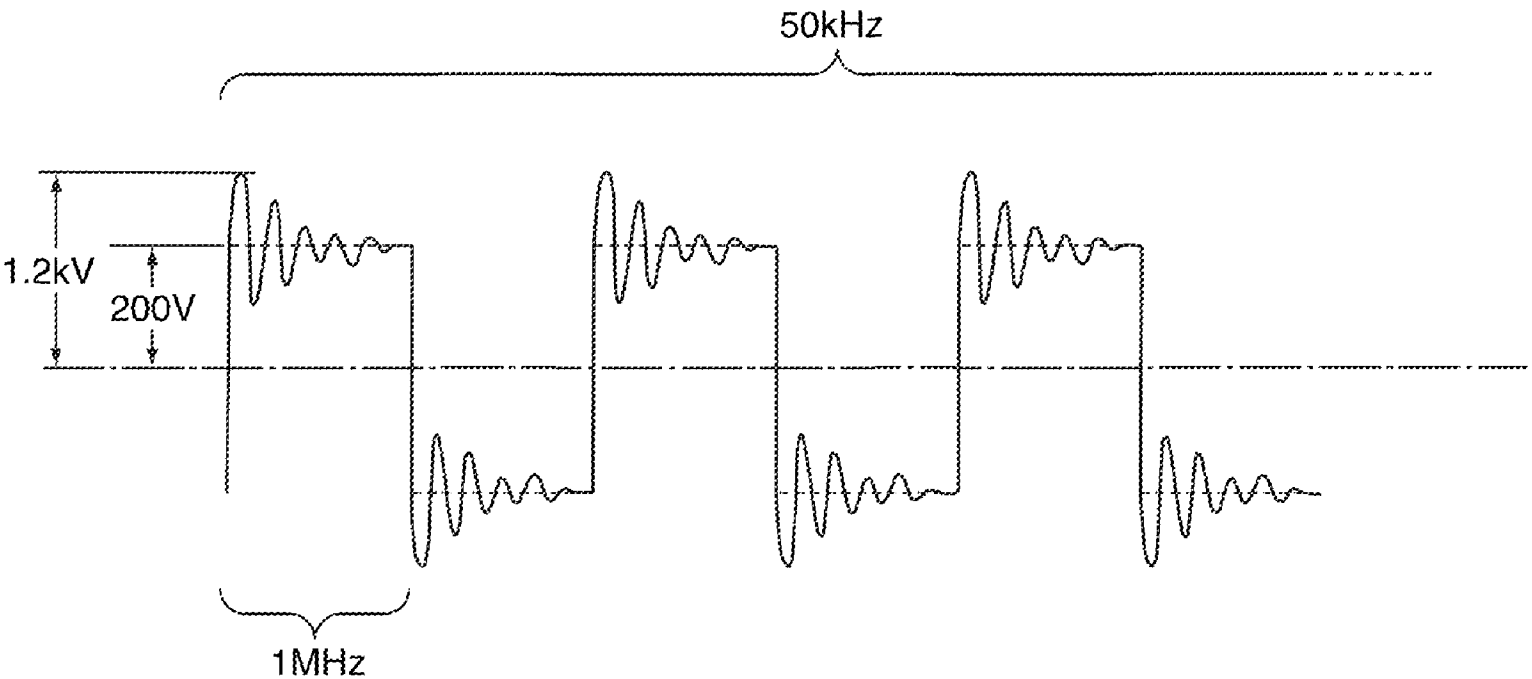
FIG. 3 shows a waveform of voltage applied to electrodes prior to operation of a pulse generating circuit according to the embodiment.

FIG. 3 shows an example of the waveform of the output voltage supplied to the discharge lamp 416 before operation of the pulse generating circuit 64.

For example, as illustrated in FIG. 3, the peak value of the output voltage to the discharge lamp 416 prior to lighting increases from 200V to 1.2 kV when inputted alternating rectangular-wave current of 50 kHz generates free oscillation of 1 MHz by the secondary coil 6422, the capacitor 643 and the capacitor 644. By applying the high-voltage pulses thus produced to the electrodes E of the discharge lamp 416, the hold condition of the discharge lamp 416 left in the cold and dark place can be canceled.

The free oscillation is so determined as not to produce a condition close to resonance condition. That is, the free oscillation is so established as to attenuate within a half cycle of a high frequency of 50 kHz, for example. More specifically, according to this embodiment, the free oscillation generated by the secondary coil 6422 and the capacitors 643 and 644 can be rapidly attenuated by providing relatively small capacities of the capacitors 643 and 644 and setting the frequency of the free oscillation at a relatively high frequency such as 1 MHz.

The frequency of the free oscillation is determined by the constant of the secondary coil 6422 as the inductor and the constants of the capacitors 643 and 644. The peak voltage (such as 1.2 kV) produced by the free oscillation is determined in accordance with the frequency of the free oscillation.

The conditions such as voltage necessary for canceling the hold condition vary according to the types of the discharge lamp 416, the installation condition and the like. Thus, the optimum values for securely canceling the hold condition are experimentally measured beforehand, and the conditions such as the capacities of the capacitors and the drive frequency are determined based on the optimum values.

The capacitors 643 and 644 are only required to generate voltage necessary for canceling the hold condition of the discharge lamp 416 left in the cold and dark place by producing large ringing of the output from the secondary coil 6422. Thus, the capacities of the capacitors 643 and 644 may be relatively small (such as several tens pF).

After the high voltage is applied (hold condition is canceled), the insulation between the electrodes E1 and E2 is broken by applying the high-voltage pulses described above to the electrodes E. As a result, the electric conduction between the electrodes E1 and E2 is secured to turn on the discharge lamp 416.

The discharge lamp 416 turned on by this method operates under a constant voltage load (such as in the range from about 10V to about 150V), and performs constant power control according to the output voltage and output current from the voltage reducing circuit 61 detected by the controller 7.

Structure of Controller

As explained above, the controller 7 controls the operation of the lighting device 6 under the control of the control unit 93 based on the output voltage and output current from the voltage reducing circuit 61. For example, as described above, the controller 7 connected with the voltage reducing circuit 61 applies the gate voltage to the FET of the voltage reducing circuit 61 to reduce current supplied from the voltage reducing circuit 61 to the converting circuit 62.

In addition, the controller 7 connected with the respective FETs 621 and 622 included in the converting circuit 62 outputs the gate voltage to the FETs 621 and 622 to allow the converting circuit 62 to generate alternating current from direct current. In this case, the controller 7 produces alternating current having the frequencies described above by changing the drive frequency of the converting circuit 62, and applies the gate voltage to the FET 6414 of the primary circuit 641. The change of the drive frequency of the converting circuit 62 under the control of the controller 7 is carried out after sufficient charges are accumulated in the capacitor 6413 of the primary circuit 641. In this embodiment, the controller 7 determines the time when the sufficient charges are accumulated based on the elapsed time from the operation start of the lighting device 6.

According to the projector 1 in this embodiment, the following advantages are offered.

The secondary coil 6422 and the capacitors 643 and 644 of the pulse generating circuit 64 generate free oscillation of current applied to the electrodes E to increase voltage applied to the electrodes E of the discharge lamp 416. In this case, the necessity for providing a resonating circuit separately from the pulse generating circuit 64 is eliminated, and the structure of the lighting device 6 is simplified. Accordingly, miniaturization and cost reduction demanded for products such as the projector 1 can be achieved.

The capacitors 643 and 644 and the output ends of the secondary coil 6422 are connected with the electrodes E of the discharge lamp 416 via the leads. In this case, high voltage is not applied to other components (such as circuit elements) provided at positions other than in the power source path of the lighting device 6. Thus, loads imposed on the respective components such as the circuit elements constituting the lighting device 6 can be reduced.

When a resonating circuit is provided between the converting circuit 62 and the pulse generating circuit 64, for example, high voltage is generated on the downstream side of the resonating circuit. Thus, loads on the respective components disposed downstream from the resonating circuit increase. According to this structure, however, the resonating circuit is not equipped, and these loads are not produced. Moreover, since the high voltage reaches the peak value in a short period, deteriorations of the circuit substrate, the circuit elements and other components caused by application of high voltage can be reduced.

For dielectric breakdown between the electrodes, only voltage sufficient for canceling the hold condition of the discharge lamp 416 left in the cold and dark place is required. Thus, the capacities of the capacitors 643 and 644 can be reduced to be smaller than those in a structure including the resonating circuit described above.

More specifically, the capacitors 643 and 644 may have 1 to 2 digits smaller capacities than those of capacitors constituting a resonating circuit disposed at a position indicated by a dotted line P between the converting circuit and the pulse generating circuit 64 (in place of the capacitor 63).

The pulse generating circuit 64 is required to be equipped with the transformer 642 for transforming (boosting) voltage. However, since the secondary coil 6422 of the transformer 642 is used as the inductor, the necessity for providing an additional inductor for generating free oscillation is eliminated. Accordingly, the structure of the pulse generating circuit 64, and thus the structure of the lighting device 6 can be further simplified.

Modification of Embodiment

The invention is not limited to the embodiments described herein but includes modifications, improvements and the like within the scope of the invention.

According to this embodiment, the lighting device 6 includes the voltage reducing circuit 61, the converting circuit 62, the capacitor 63, and the pulse generating circuit 64. However, a waveform shaping circuit, a protection circuit and the like may be added according to the specifications of the controller 7, for example. The circuit structure may be constructed otherwise as long as it can provide functions similar to those described herein. For example, while the two capacitors 643 and 644 are equipped for producing free oscillation in this embodiment, the number of the capacitors for generating the free oscillation may be one, three or a larger number.

According to this embodiment, the secondary coil 6422 of the transformer 642 is used as the inductor for generating the free oscillation in cooperation with the capacitors 643 and 644. However, a separate inductor for generating the free oscillation may be provided between the secondary coil 6422 and the capacitors 643 and 644.

According to this embodiment, the pulse generating circuit 64 has the FET 6414 as the switching element. However, the pulse generating circuit 64 may have other structure as long as high-voltage pulses can be applied to the electrodes E according to a predetermined signal input. Also, other switching elements such as other transistors and thyristors may be employed. Alternatively, discharging gap may be adopted.

According to this embodiment, the frequency at which the converting circuit 62 is driven prior to lighting of the discharge lamp 416 is kept constant (such as 50 kHz). However, the frequency may be changed to a desired frequency by the controller 7 to adjust the output from the pulse generating circuit 64 to the electrodes E of the discharge lamp 416 to a desirable amount according to the installation environment of the projector 1 and the like.

According to this embodiment, free oscillation is produced to cancel the hold condition of the discharge lamp 416 left in the cold and dark place. However, the peak voltage raised by the free oscillation may be used when sufficient voltage is not generated by the pulse generating circuit 64 for other reasons, for example. Moreover, the frequency of the free oscillation set at 1 MHz in this embodiment may be a high frequency (specifically, in the range from about 500 kHz to about 3 MHz) which attenuates within a half cycle, and high peak voltage (specifically, in the range from about 500V to about 2 kV) may be produced, for example.

According to this embodiment, the high voltage raised by the free oscillation is applied to the electrodes E prior to application of the high voltage pulses both when the discharge lamp 416 is left in the cold and dark place and when the discharge lamp 416 is not left therein (in the normal condition). However, a temperature sensor or the like may be provided on the projector to generate free oscillation of current applied to the electrodes E when the detected temperature is lower than a predetermined temperature and not to generate the free oscillation when the detected temperature is higher than the predetermined temperature, for example.

According to this embodiment, the projector 1 including the three liquid crystal panels 442R, 442G, and 442B has been discussed. However, the invention is applicable to a projector including two or a smaller number of or four or a larger number of liquid crystal panels.

While the image forming system 4 has a substantially L shape in the plan view in this embodiment, the image forming system 4 may have a substantially U shape in the plan view.

While the liquid crystal panels 442 each of which has a surface for receiving light and a surface for releasing light as different surfaces are used in this embodiment, reflection-type liquid crystal panels each of which has the same surface for receiving light and releasing light may be employed.

According to this embodiment, the projector 1 includes the liquid crystal panels 442 as the light modulation devices. However, light modulation devices having other structure may be used as long as they can modulate entering light according to image information and form optical images. For example, the invention is applicable to a projector which has devices containing micromirros other than liquid crystals. In case of the light modulation devices of this type, the entrance side and exit side polarization plates 443 and 445 can be eliminated.

According to this embodiment, the lighting device 6 for turning on the discharge lamp 416 is included in the projector 1. However, the lighting device 6 may be incorporated in an illumination device such as a desk lamp. In addition, the lighting device 6 may be used separately and independently.

Accordingly, the technology of the invention is applicable to a lighting device of a discharge lamp, and particularly appropriately used for a lighting device included in a projector.

The entire disclosure of Japanese Patent Application No. 2009-211376, filed Sep. 14, 2009 is expressly incorporated by reference herein.

What is claimed is:

1. A lighting device which supplies power to an electrode of a discharge lamp to turn on the discharge lamp, comprising:

a converting circuit that converts an inputted direct current into alternating current;

a pulse generating circuit which produces a high-voltage pulse and applies the high-voltage pulse to the electrode, the pulse generating circuit including a transformer having a primary coil and a secondary coil;

wherein the pulse generating circuit includes an inductor whose input end is directly connected with an output of the converting circuit and whose output end is directly connected with the electrode, the inductor corresponding to the secondary coil, and a capacitor connected with the output end of the inductor to produce free oscillation of current applied to the electrode in cooperation with the inductor.

2. The lighting device according to claim 1, wherein:

the transformer has a plurality of secondary coils, the plurality of secondary coils is connected with a plurality of electrodes of the discharge lamp respectively.

3. The lighting device according to claim 1, wherein:

the pulse generating circuit has a plurality of inductors, the plurality of inductors is connected with the plurality of electrodes of the discharge lamp respectively.

4. The lighting device according to claim 1, wherein:

the capacitor has a composition to which a plurality of capacitors are connected in series.

5. The lighting device according to claim 1, wherein:

the output end of the inductor is connected with the electrode via a lead.

6. A projector comprising the lighting device according to claim 1.

7. The lighting device according to claim 1, wherein:

the pulse generating circuit includes first and second inductors.

8. The lighting device according to claim 1, wherein:

a frequency of an alternating current generated by the converting circuit is different from the resonance frequency dependent on the inductor and the capacitor of the pulse generating circuit.

9. The lighting device according to claim 1, wherein:

the pulse generating circuit includes a plurality of capacitors.

* * * * *